US005829919A

United States Patent [19]

Heerema

[11] Patent Number: 5,829,919

[45] Date of Patent: Nov. 3, 1998

[54] METHOD AND INSTALLATION FOR REMOVING A SUPERSTRUCTURE

[75] Inventor: Edward Pieter Heerema, Châtel-St. Denis, Switzerland

[73] Assignee: Allseas Group S. A., Switzerland

[21] Appl. No.: 742,859

[22] Filed: Nov. 1, 1996

[30] Foreign Application Priority Data

Nov. 3, 1995 [NL] Netherlands ..... 1001565
Nov. 29, 1995 [NL] Netherlands ..... 1001778

[51] Int. Cl.[6] ..... E02B 17/00

[52] U.S. Cl. ..... 405/209; 405/204

[58] Field of Search ..... 405/209, 204, 405/203, 205, 206

[56] References Cited

U.S. PATENT DOCUMENTS 2,817,212 12/1957 Stubbs ..... 405/209
4,714,382 12/1987 Khachaturian ..... 405/204
4,744,697 5/1988 Coppens ..... 405/204
4,973,200 11/1990 Kaldenbach ..... 405/209
5,403,124 4/1995 Kocaman et al. ..... 405/209
5,522,680 6/1996 Hoss et al. ..... 405/209

*Primary Examiner*—David J. Bagnell
*Assistant Examiner*—Frederick L. Lagman
*Attorney, Agent, or Firm*—Mark Zovko

[57] ABSTRACT

A method for removing a superstructure from a jacket placed on a sea-bottom, wherein a vessel is positioned in the vicinity of the jacket. In this operation, the problem of the superstructure colliding with the jacket during lifting thereof due to up and down movement caused by the vessel floating on the waves is real and present. The superstructure and/or the jacket can sustain damage. To avoid such damage, the superstructure is engaged by lift supports which are movable relative to the vessel. Once the movement of the vessel in the waves is detected, lifting of the superstructure from the jacket is started when it is detected that the vessel is situated below it's average depth level in the sea.

9 Claims, 7 Drawing Sheets

METHOD AND INSTALLATION FOR REMOVING A SUPERSTRUCTURE

The invention relates to a method for removing a superstructure from a jacket placed on a sea-bottom, herein a vessel is positioned in the vicinity of the jacket. Such a method is known. There is the danger therein of the superstructure colliding with the jacket during lifting thereof because it moves up and down with the vessel floating on the waves. The superstructure and/or the jacket can herein be damaged.

The invention has for its object to avoid such damage. To this end the method according to the invention has the characteristic of claim 1.

In order to further lift the superstructure after engaging thereof, diverse further steps can be taken, preferably one or more of the steps according to claims 2–5.

The invention also relates to and provides an installation as according to claim 6.

Mentioned and other features according to the invention will be elucidated in the description following hereinbelow with reference to a drawing, in which.

Figure 1:
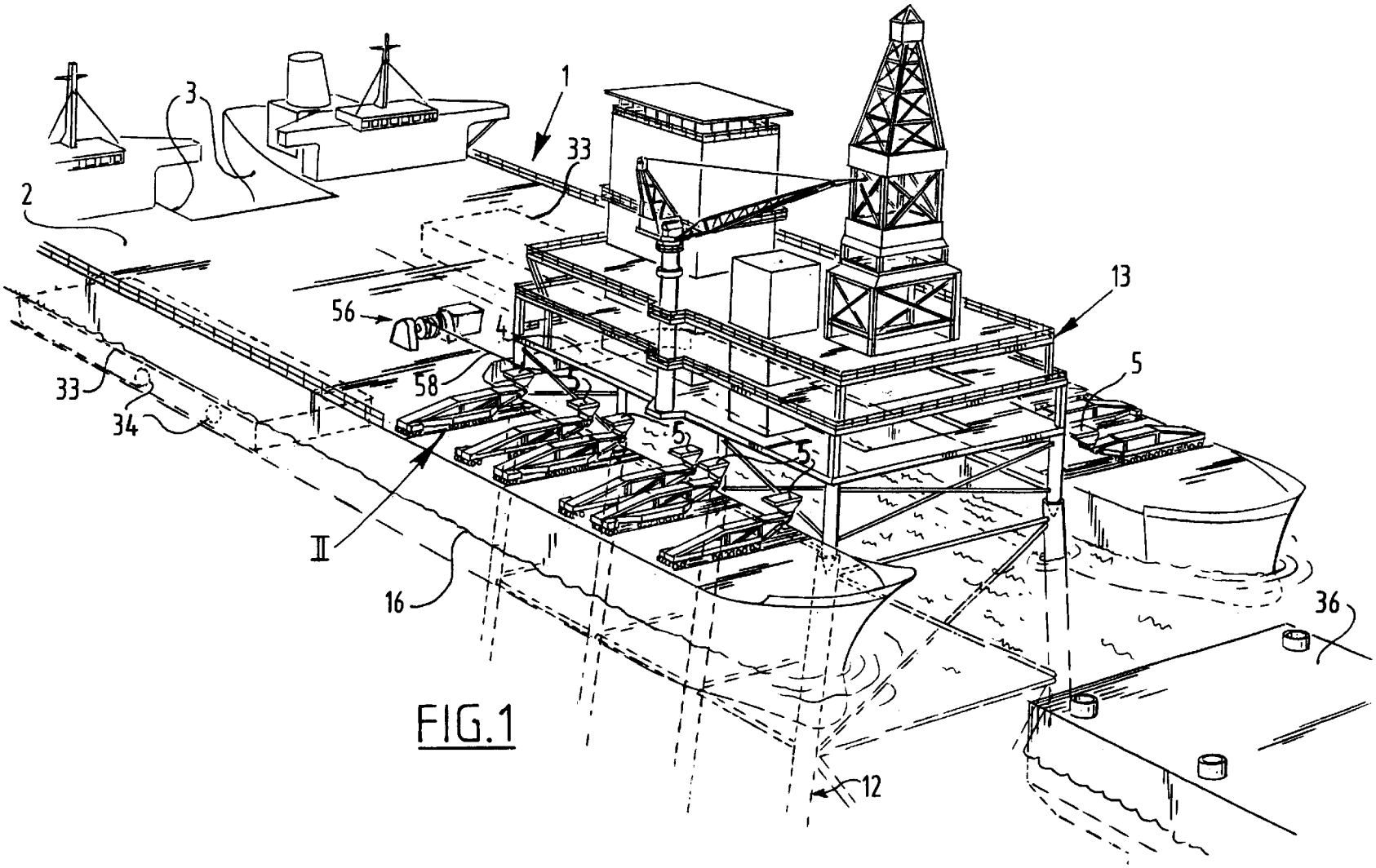
FIG. 1 shows a perspective view of an installation according to the invention at a jacket having a superstructure for removal.

The installation 1 according to the invention comprises a vessel 2, constructed for instance from two bulk carriers 3 which are combined to form a whole while leaving clear an open space 4 between their two front ends.

The installation 1 further comprises engaging means which are formed by lifting supports 5 which are each hingedly connected along a hinge 7 to a pivot arm 6 which is pivotally connected on a pivot shaft 8 to a carriage 9 which, for instance by means of electric motors driving wheel shafts, can travel over vessel 2 over rails 10 extending in transverse direction. Pivot arm 6 can be pivoted by means of a hydraulic cylinder 11. Each lifting support 5 is guided by means of guide rods 46 which are oriented parallel to pivot arm 6 and which are pivotable on shafts 47 and 48. Each lifting support 5 has a C-shaped sliding piece 49 arranged slidably thereon.

Figure 3:
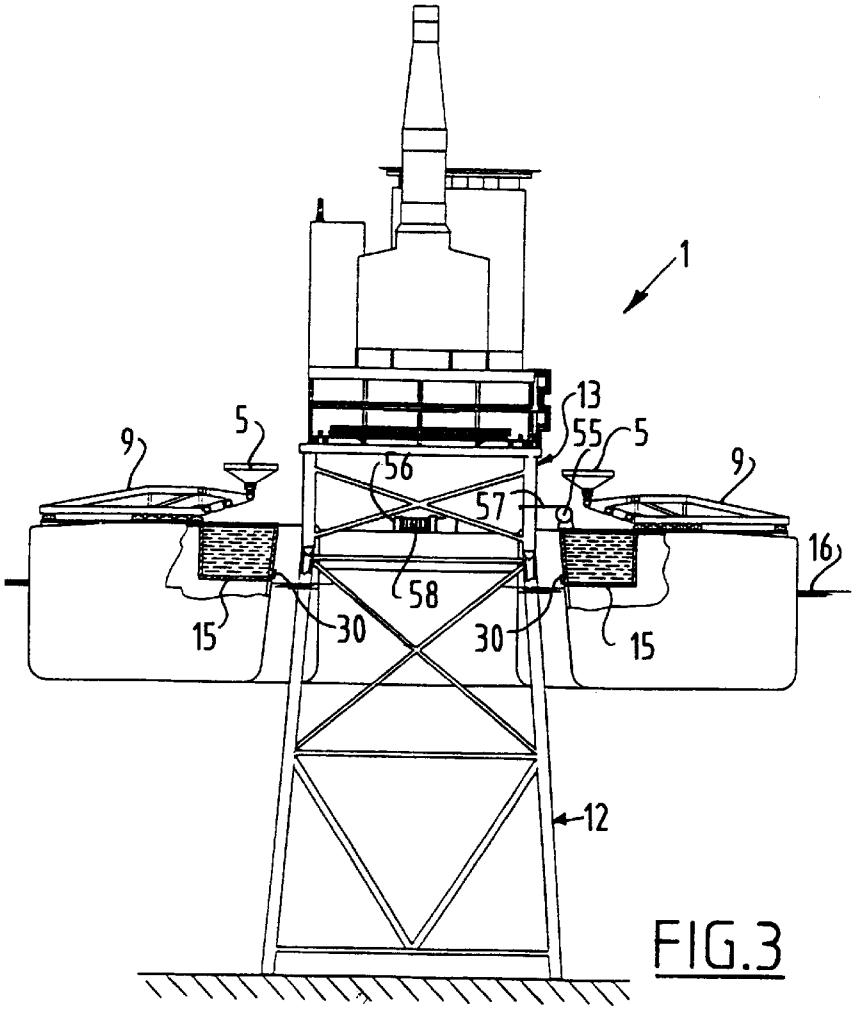
Figure 6:
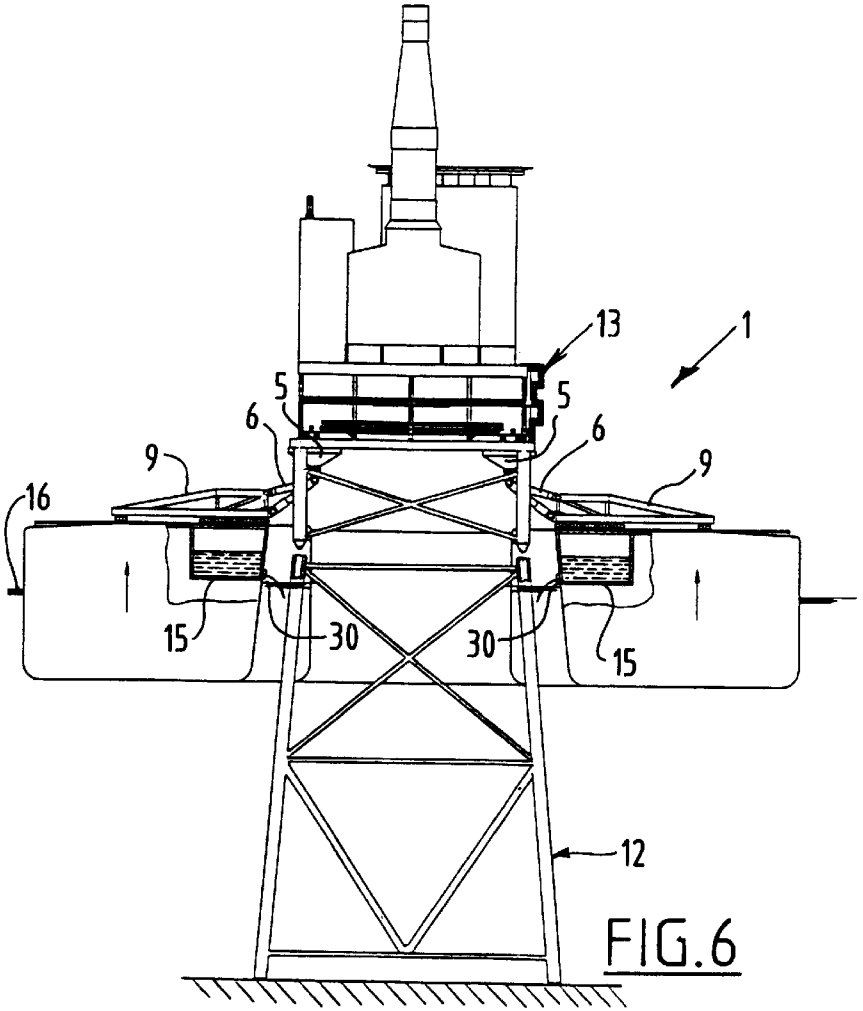
Figure 5:
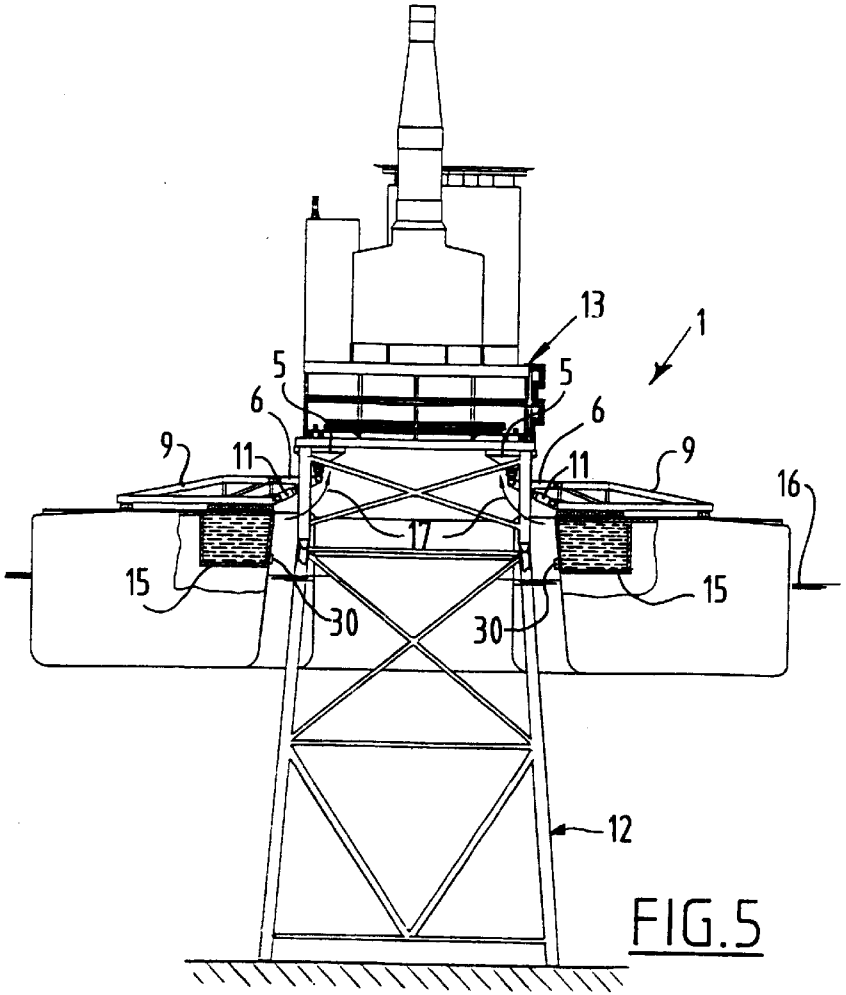

In the method according to the invention a superstructure 13 is removed from a jacket 12 standing on a sea-bottom. In a first step the vessel 2 is herein positioned with its open space 4 round the jacket 12 (FIG. 3).

Figure 4:
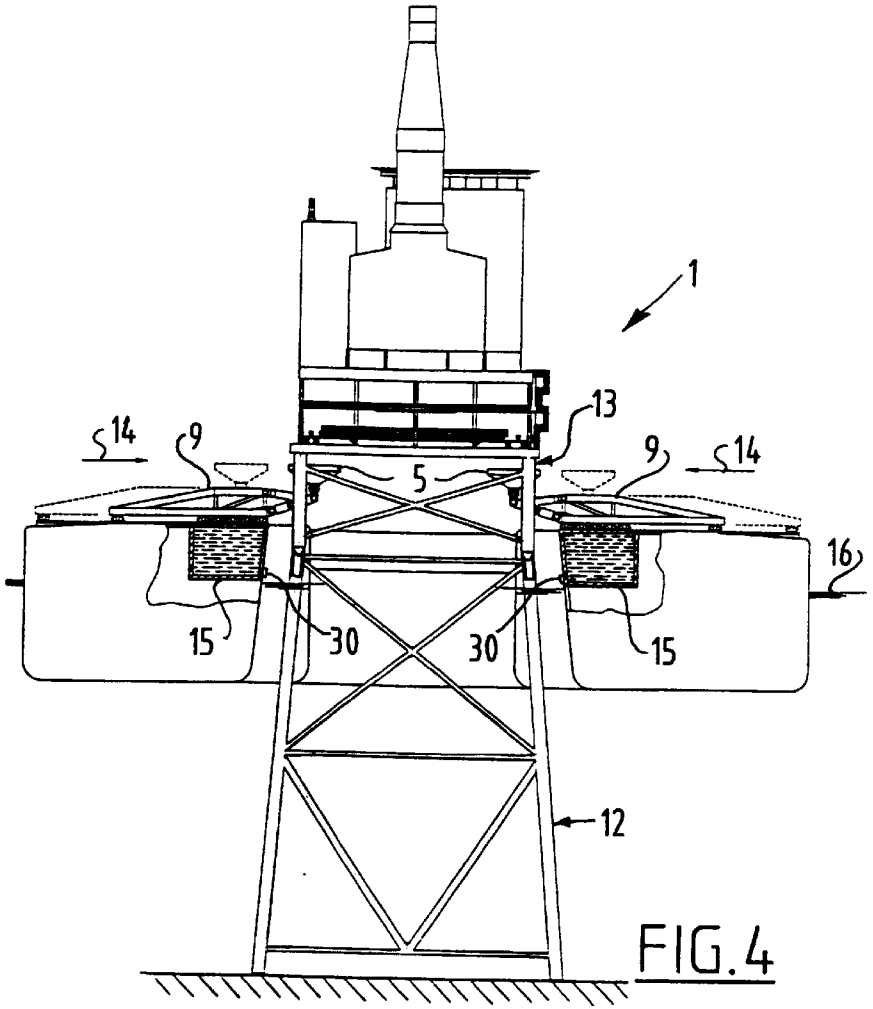
FIGS. 3–7 show schematically the successive steps during performing of the method according to the invention.

In a second method step the carriages 9 are moved in transverse direction as according to arrows 14 toward jacket 12 such that the lifting supports 5 are situated under superstructure 13 (FIG. 4). Above the water level 16 the vessel 2 has in its front end in each of the bulk carriers 3 a ballast tank 15 which is filled with water by means of pump means (not shown).

Figure 9:
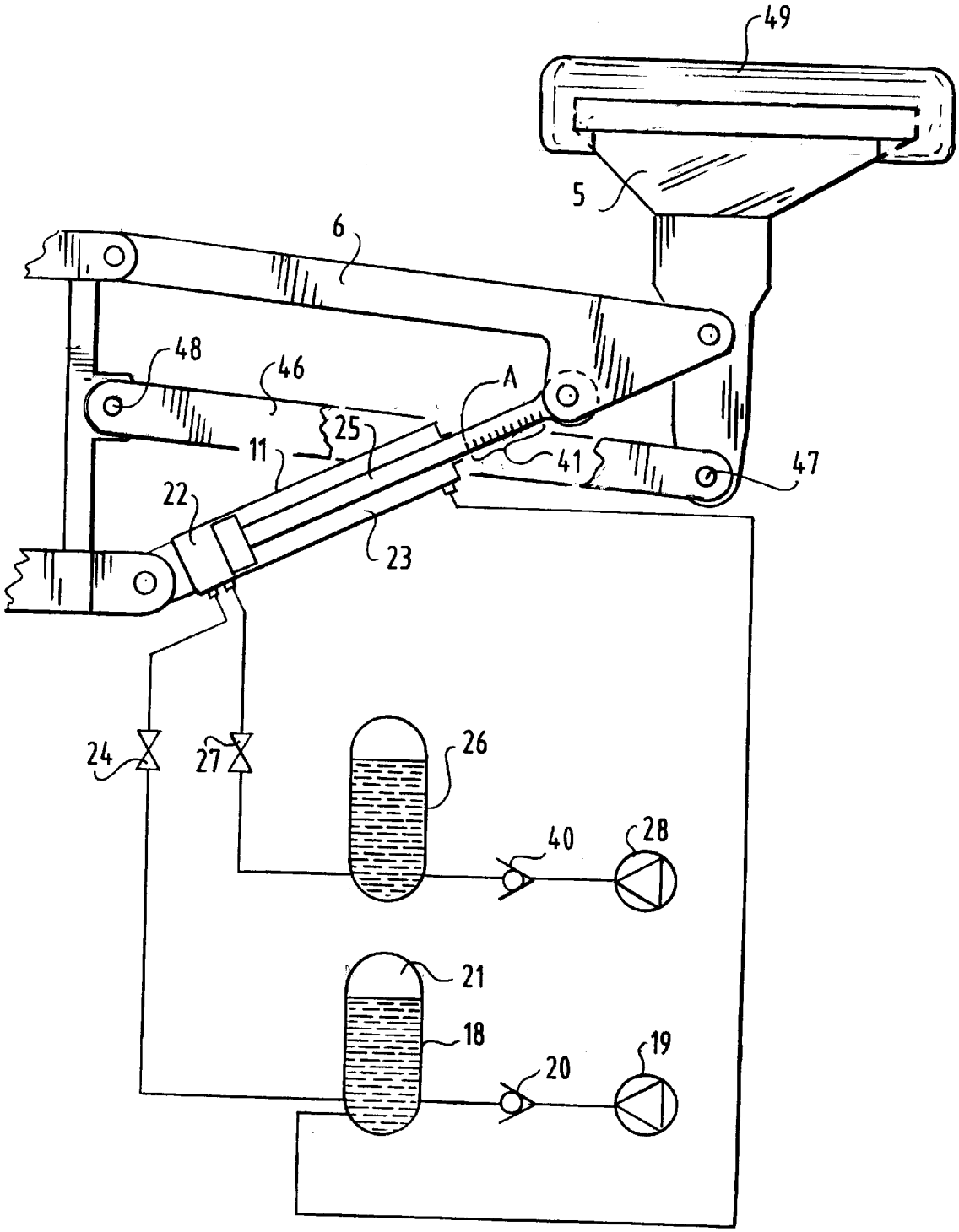
FIG. 9 shows a hydraulic diagram.

In a third step lifting supports 5 are pivoted upward as according to arrows 17 until their sliding pieces 49 are situated against the underside of super-structure 13. According to the hydraulic diagram of FIG. 9 liquid is for instance pumped for this purpose by means of a pump 19 via a non-return valve 20 into a buffer reservoir 18 in which is situated an air chamber 21. Buffer reservoir 18 is connected onto both chambers 22 and 23 of hydraulic cylinder 11, although between chamber 22 and buffer reservoir 18 is situated a valve 24 which is open in this method step. Each lifting support 5 thus engages with a comparatively small upward pressure force against the underside of the superstructure. The pivot arms 6 move up and downward to the extent that vessel 2 moves up and downward on the waves. The carriages 9 can move freely relative to vessel 2 over rails 10. The lifting supports 5 engage on the superstructure by means of the sliding pieces 49 which extend in longitudinal direction of vessel 2, wherein in this third step at a small pressure the lifting supports 5 can displace in longitudinal direction of these sliding pieces 49. In this third step vessel 2 can move and rotate slightly in all directions relative to superstructure 13. In order to provide a rotation option elastic means and/or extra pivot shafts (not shown) are for instance built into lifting support 5.

The movements of vessel 2 on the waves are meanwhile picked up in one way or other, for instance on the basis of the stroke made by the piston rod 25 of a cylinder 11. On the basis of graduations 41 on piston rod 25 it is determined for a time, for instance 10 minutes, what is the maximum inward position A of piston rod 25. When at a given moment this maximum inward position A is again reached, this is the indication of a deep vessel level, for instance in the order of magnitude of 0.5 m below the average vessel level. At this moment (beginning of a fourth method step), at least at a moment when the situation of a deep vessel level occurs, the valve 24 is closed, whereby the inward movement of piston rod 25, and thus the downward movement of lifting supports 5, is blocked. Simultaneously or subsequently the chamber 22 of each cylinder 11 is connected to a hydraulic accumulator 26 under high pressure by opening a valve 27. In a short time the superstructure 13 is hereby lifted additionally relative to vessel 2. Hydraulic accumulator 26 is brought to high pressure beforehand by means of a pump 28 via a non-return valve 40. In this fourth method step the ballast tank 15 is simultaneously emptied by opening large water valves 30 so that the water leaves ballast tank 15 quickly. In order to accelerate this process the ballast tanks 15 are preferably placed under pressure beforehand by pumping in air above the water. By emptying ballast tank 15 the front end of the vessel 2 rises relative to the water level 16.

The vessel 2 preferably has in its rear end ballast tanks 33 which are located below water level 16 and provided with large closable water inlets 34 which are opened in this fourth method step. The rear end of vessel 2 hereby sinks while the front end rises through tilting.

Figure 8:
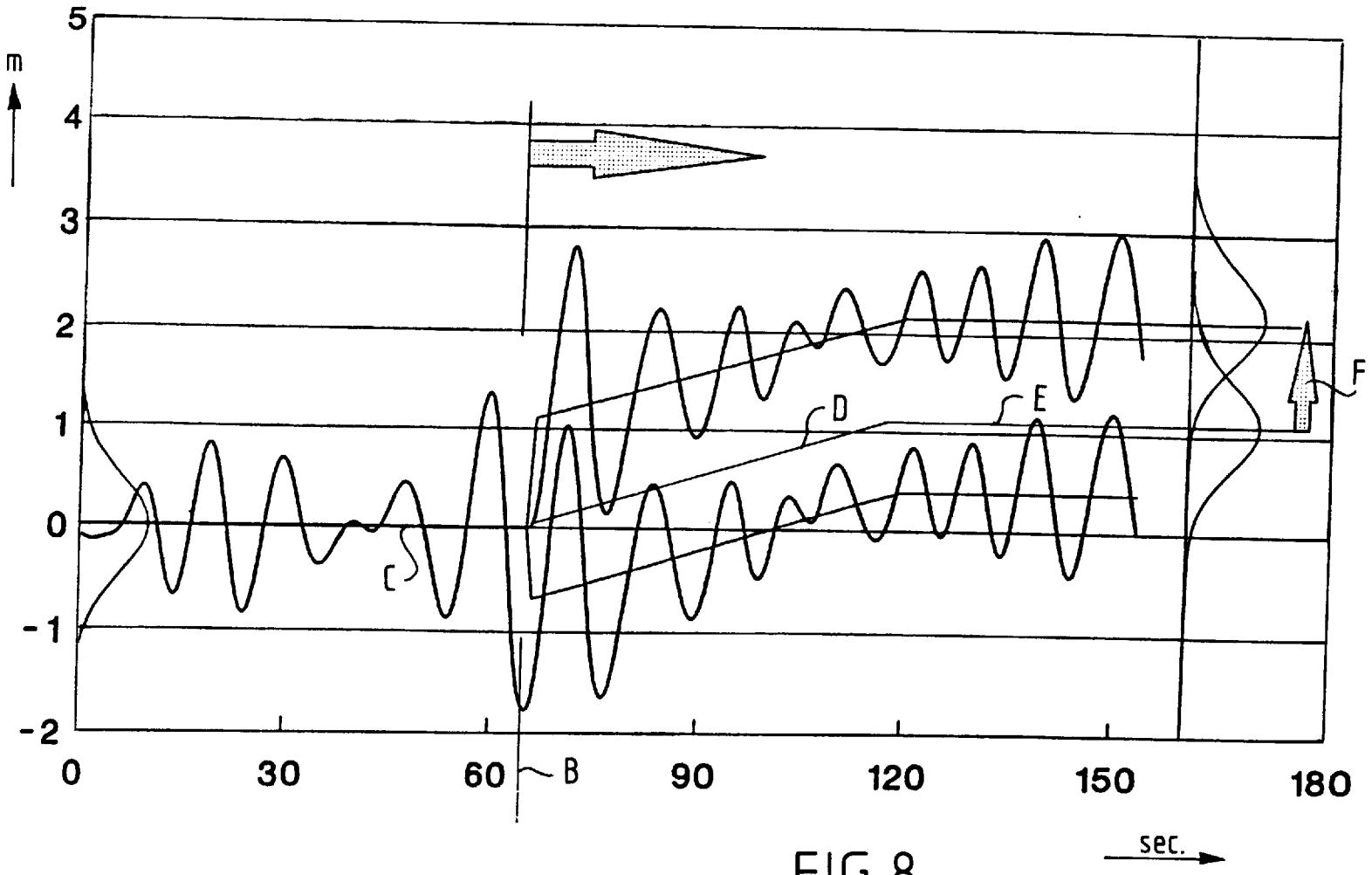
FIG. 8 is a graph which shows the vertical movement of the vessel and of the superstructure resulting from the wave surge in addition to the statistical distribution of these movements.

In FIG. 8 a deep wave trough is detected at for instance the point in time B. Through blocking of the inward stroke of piston rod 25 as according to line D the average wave depth C changes to level E. Due to one or more of the said additional steps for lifting the lifting supports 5 relative to vessel 2 and/or for lifting the level of the deck of the front end of the vessel relative to the water level, the superstructure is additionally lifted by the measure F so that the superstructure no longer collides with jacket 12 at the following deep wave trough or an even deeper wave trough.

Figure 7:
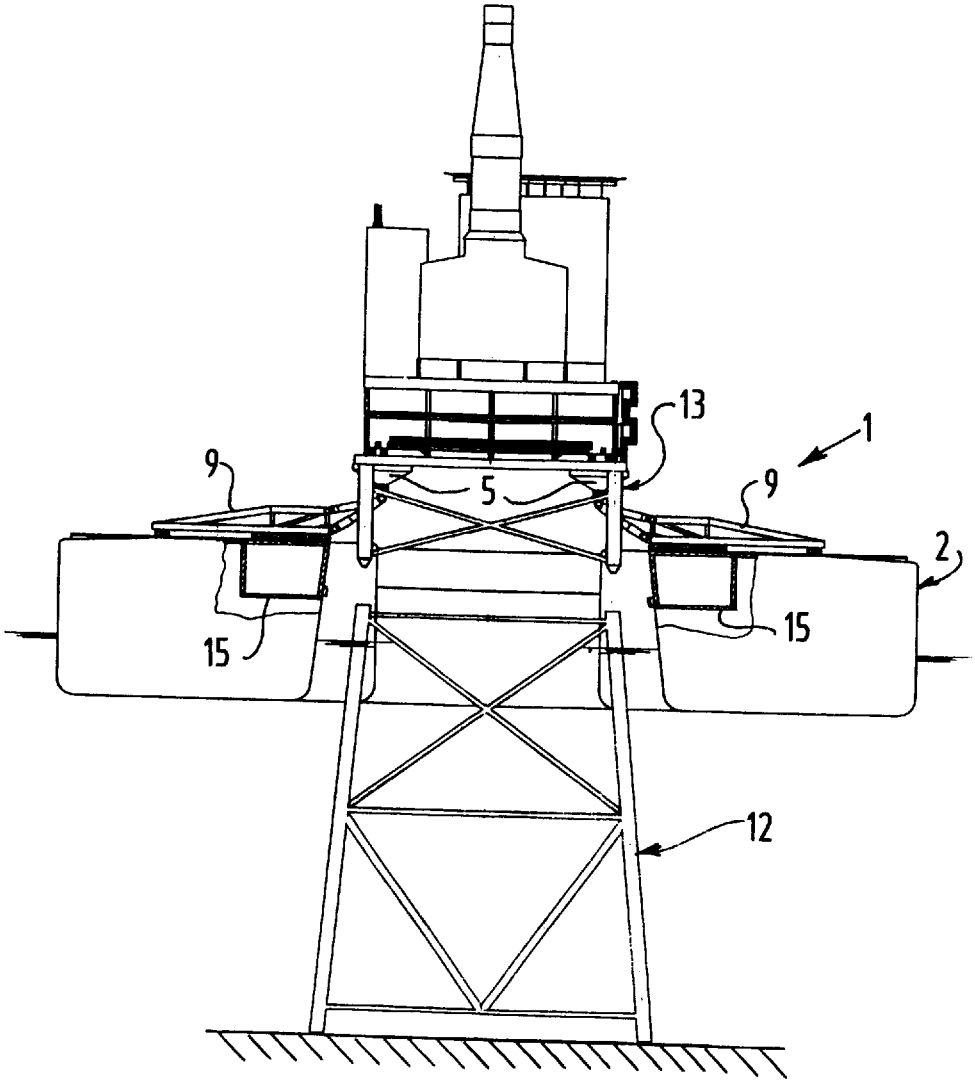

In a fifth method step the superstructure 13, supported in the raised position of FIG. 7, is navigated away from jacket 12 by vessel 2 and optionally placed on a pontoon 36 fitting into the open space 4.

The invention relates particularly to superstructures with a large weight, for instance in the order of magnitude of 50,000 tons.

The detection of the wave movement and the deep vessel level can take place in ways other than as designated above.

Figure 2:
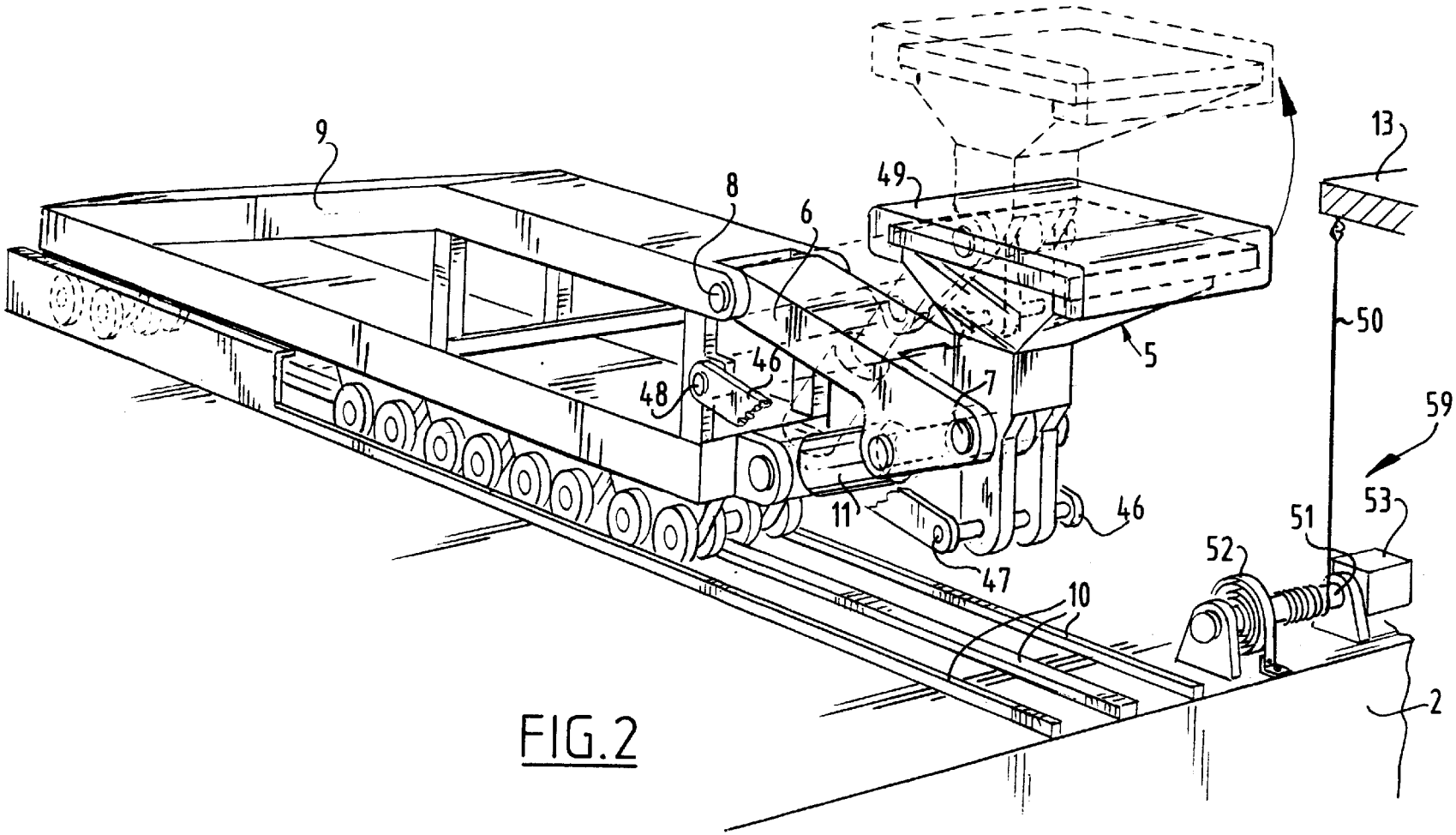
FIG. 2 is a perspective view of detail II of FIG. 1.

According to FIG. 2 a wire 50 fixed to the superstructure 13 is wound helically round a rotor 51 of pick-up 59, which rotor is mounted for rotation on vessel 2 and is rotated by a coil or spiral spring 52 such that wire 50 remains taut. A pick-up 53, for instance a pulse counter, detects the rotation of rotor 51 and therewith the up and downward movement of vessel 2 relative to jacket 12 and superstructure 13. The up and downward movements of vessel 2 are preferably analyzed with a computer and the time at which a deep vessel level occurs is pre-calculated. The fourth method step is initiated during a deep vessel level and preferably a low relative speed between vessel 2 and superstructure 13 in all directions, so that the shock caused by lifting is small. The horizontal vessel displacements relative to jacket 12 take place via pick-ups 55 and 56 which are connected by means of the respective wires 57, 58 to jacket 12, which pick-ups 55 and 56 correspond with pick-up 59. From the measurements by means of pick-ups 55 and 56 the horizontal speed of movement of the vessel is derived and therewith a point in time at which this is low or zero.

Detecting of the vessel movements for a period of time takes place in order to minimize the risks of the shock caused by lifting and is based on the currently measured statistical movement characteristics. It is of still greater importance to prevent the superstructure from colliding with the jacket. It is a known phenomenon that the highest waves (highest vessel movements) tend to form groups of two or three high waves, i.e. after a high wave there is a relatively great chance that the following wave will also be high. The forming of wave groups can also be quantified statistically and this is taken into account in the criterion formula for the starting time B.

It is possible prior to starting time B to already place the hydraulic cylinders 11 under considerable pressure, for instance by a high pressure in reservoir 18, and to apply a piston rod 25 the cross-sectional surface area of which amounts to a high percentage of the internal cross-sectional surface area of the width of chamber 22.

I claim:

1. Method for removing a superstructure (13) from a jacket (12) placed on a sea-bottom, wherein a vessel (2) is positioned in the vicinity of the jacket (12), characterized by engaging the superstructure (13) by engaging means (5) which are fixed in movement relative to the vessel (2) in a downward direction, detecting the movement of the vessel (2) in the waves, and lifting the superstructure (13) from the jacket (12) when it is detected that the vessel (2) is situated below its average level.

2. Method as claimed in claim 1 characterized by displacing upward the part of the vessel (2) which supports the superstructure (13) during lifting of the superstructure by maneuvering with ballast, wherein ballast is removed on the end of the vessel which supports the superstructure (13).

3. Method as claimed in claim 1 characterized by displacing upward the part of the vessel (2) which supports the superstructure (13) during lifting of the superstructure by maneuvering with ballast wherein the end of the vessel which does not support the superstructure is provided with ballast.

4. Method as claimed in claim 1 wherein prior to fixing the movement of the engaging means, the engaging mean engages with an upward pressure against the underside of the superstructure.

5. Method for removing a superstructure (13) from a jacket (12) placed on a sea-bottom, wherein a vessel (2) is positioned in the vicinity of the jacket (12), characterized by engaging the superstructure (13) by engaging means (5) which are movable relative to the vessel (2), detecting the movement of the vessel (2) in the waves, and lifting the superstructure by a pressurized hydraulic accumulator (26) when it is detected that the vessel (2) is situated below its average level.

6. Apparatus for removing a superstructure from a jacket placed on the sea-bottom comprising a vessel (2) and engaging means (5) for engaging a superstructure (13) which are fixed in movement relative to the vessel in a downward direction, detecting means (41) for detecting the movement of the vessel (2) in the waves, in particular for detecting the situation in which the vessel (2) is situated below its average level, and energizing means (11) for energizing the engaging means (5) when the vessel (2) is situated below its average level, the vessel having ballast means whereby the part of the vessel which supports the superstructure is displaced upwardly by maneuvering with said ballast means.

7. Apparatus for removing a superstructure from a jacket placed on the sea-bottom comprising a vessel (2) and engaging means (5) for engaging a superstructure (13) which are movable relative to the vessel (2) characterized by said engaging means engaging with an upward pressure against the underside of the superstructure and detecting means for detecting the movement of the vessel (2) in the waves, particularly for detecting the situation in which the vessel (2) is situated below its average level, and by energizing means for energizing the engaging means (5) when the vessel is situated below its average level.

8. The apparatus of claim 7 which includes at least one pressurized hydraulic accumulator (26) for lifting the superstructure (13) relative to the vessel (2).

9. The apparatus of claim 7 which includes measuring means (55, 56) for measuring horizontal vessel movements.

* * * * *